United States Patent [19]

Watts

[11] Patent Number: 5,014,469

[45] Date of Patent: May 14, 1991

[54] SHOT REMOVAL SYSTEM

[76] Inventor: W. David Watts, 4965 Highway 19 N., Alpharetta, Ga. 30201

[21] Appl. No.: 400,481

[22] Filed: Aug. 30, 1989

Related U.S. Application Data

[63] Continuation-in-part of Ser. No. 42,464, Apr. 24, 1987, Pat. No. 4,872,294, which is a continuation-in-part of Ser. No. 824,460, Jan. 31, 1986, abandoned.

[51] Int. Cl.[5] ..... B24C 9/00

[52] U.S. Cl. ..... 51/425; 51/273; 51/417; 51/426

[58] Field of Search ..... 51/417, 420, 424, 425, 51/273, 418, 426

[56] References Cited

U.S. PATENT DOCUMENTS

| | | | |
|---|---|---|---|
| 2,204,588 | 6/1940 | Guite | 51/418 |
| 2,777,256 | 1/1957 | Paasche | 51/418 |
| 2,923,109 | 2/1960 | Pelley | 51/417 |
| 2,952,100 | 9/1960 | Pelley | 51/417 |
| 2,993,309 | 7/1961 | Barnes et al. | 51/417 |

FOREIGN PATENT DOCUMENTS

| | | | |
|---|---|---|---|
| 0045018 | 2/1982 | European Pat. Off. | 134/7 |
| 3338980 | 5/1985 | Fed. Rep. of Germany | 51/425 |

*Primary Examiner*—Robert A. Rose

*Attorney, Agent, or Firm*—William Nitkin

[57] ABSTRACT

A shot removal system disposed immediately after a shot blast chamber for removal of shot remaining on the workpiece having a blower adapted to blow air laterally across the top surface of the workpiece, blowing air and shot perpendicularly to the direction of movement of the workpiece and a suction device disposed opposite the blower pulling large volumes of air and shot in the same direction as the blower is blowing the shot including an expansion chamber separating shot from waste debris and a return apparatus for recycling shot for re-utilization in the blast chamber.

6 Claims, 2 Drawing Sheets

SHOT REMOVAL SYSTEM

This application is a continuation-in-part of my previous application for Bar and Coil Descaler, Ser. No. 042,464 filed Apr. 24, 1987, now U.S. Pat. No. 4,872,294, which is a continuation-in-part of my previous application for a Bar Descaler, Ser. No. 824,460, filed Jan. 31, 1986, now abandoned.

BACKGROUND OF THE INVENTION

1. Field of the Invention

The apparatus of this invention resides in the area of blast machines and more particularly relates to a shot removal system of a blast machine which propels shot at metal sheets or plates in order to clean them so that they are in suitable condition for further processing.

2. Description of the Prior Art

Blast machines have been used in the prior art to clean sheets, strips and plates of metal, some of which may initially be provided in the form of rolls or coils, for cleaning and descaling by delivering such workpieces on conveyors through long chambers which have shot blast wheels disposed above and below the sheet metal being cleaned. Such prior art machines have provided a plurality of shot blast wheels disposed in such long chamber through which the sheet is passed wherein each shot blast wheel cleans a specific portion of the upper or lower surface of the sheet.

Since many of the prior art chambers are as long as 20 feet, the accumulation of shot on the top surface of the sheet is considerable and must be removed from the sheet as it exits the blast chamber for further processing.

In the prior art several processes have been used to try to remove the shot from the top of the sheet. One method incorporates a series of brushes that sweep parallel to the direction of movement of the metal sheet, which method attempts to brush the shot off the sides of the metal sheet. This removal method has been found to be inefficient with shot still remaining on top of the metal sheet as the sheet passes out of the chamber. The presence of such shot on top of the metal sheet is undesirable as it interferes with further processing of the workpiece. Another method which has been utilized in the past to remove such shot provides for blowers located at the exit of the chamber which blow the shot back into the chamber in line with, but in the opposite direction to, the flow of the workpiece. These blowers attempt to blow the shot off the top of the metal sheet. This method also has proven to be less than 100% effective in that many times more shot will be deposited and left on top of the steel sheets than the blowers can effectively remove. Such blowers will sometimes blow shot back into the path of oncoming shot from the blast wheels thereby interfering with effective cleaning of the metal sheets.

SUMMARY OF THE INVENTION

It is an object of this invention to remove shot buildup on the top surface of a metal sheet workpiece after it has been cleaned by shot blast machines.

In practice, after a metal sheet has passed beyond the shot blast patterns of an upper and lower shot blast wheel, any shot remaining on top of the sheet is removed by the cleaning system of this invention which is disposed at the rear of the blast chamber. When the sheet exits the blast chamber, it enters a shot removal chamber. A strong blast of air is provided from the side of the sheet perpendicular to its direction of movement. The air blast is provided by a blower directed within the removal chamber which is approximately 2–10 inches in depth and which blows the shot across the surface of the sheet. At the other end of this chamber is a high-volume suction apparatus which provides a suction of greater force than the force of the initial blower and this suction completely eliminates all shot and debris from the top surface of the sheet as it passes through the shot removal chamber. The suction apparatus directs the removed shot and debris through an expansion chamber where there is an upwards draft caused by the suction. A dust collector then carries the dust and non-shot debris from the cleaning process away from the shot, and the shot falls to the bottom of the removal chamber by gravity. At the same time the separated dust and lighter debris is pulled away by suction to a dust collector. The debris is thus separated from the shot, and the shot is thereby cleaned and carried by a lower auger to an elevator to be recycled through the device of this invention.

DESCRIPTION OF THE PREFERRED EMBODIMENT(S)

Figure 1:
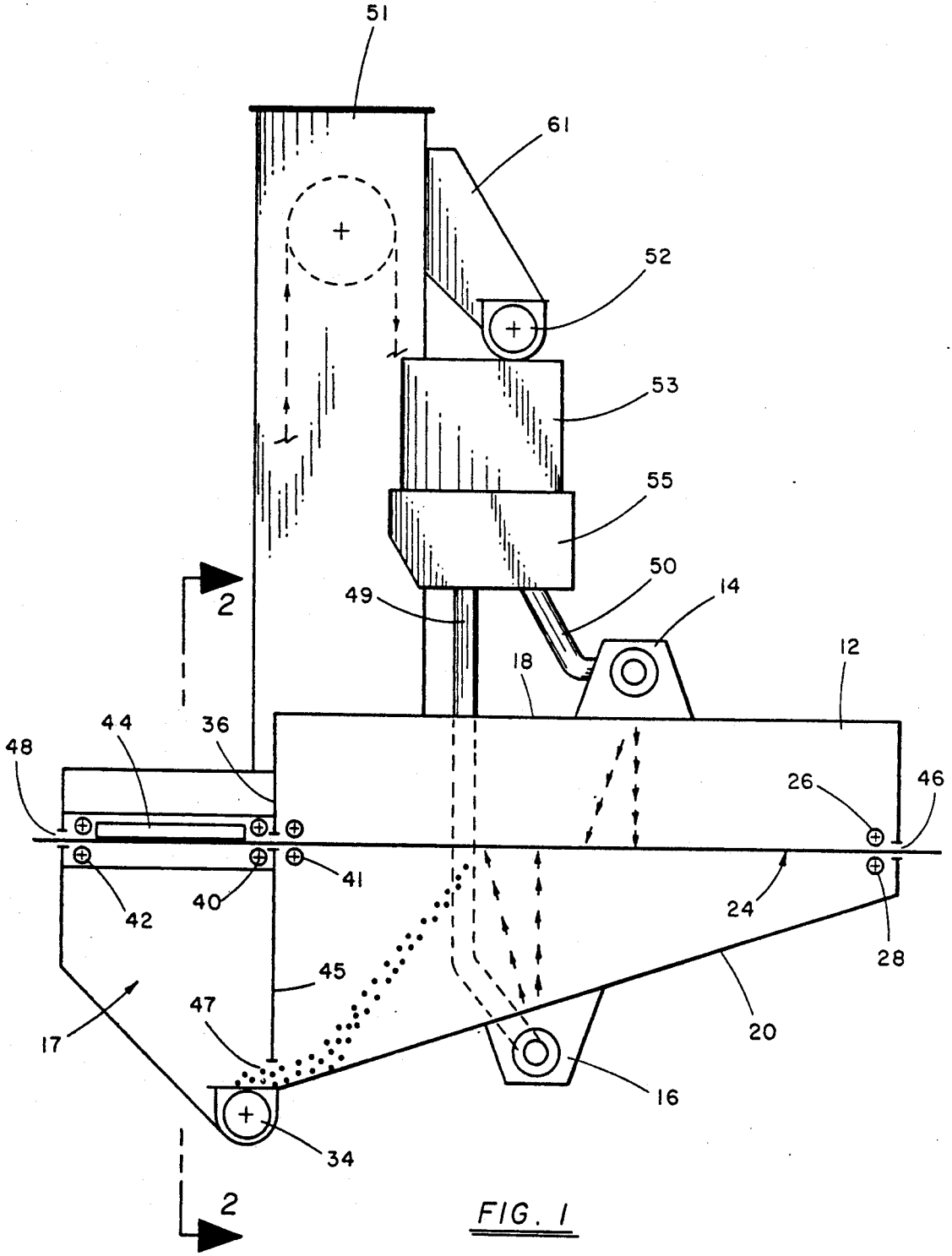
FIG. 1 illustrates a side elevational cutaway view of a blast chamber and the shot removal chamber of this invention.

FIG. 1 illustrates a side elevational cutaway view of the device of this invention showing blast chamber 12 and shot removal chamber 17. Seen in this view is first upper blast wheel 14 disposed on upper chamber wall 18. First lower blast wheel 16 is similarly disposed on lower chamber wall 20. Workpiece 24 passes into blast chamber 12 through entry door 46 between first upper conveyor roller 26 and first lower conveyor roller 28. The entry door 46 can be 2–15 feet wide to allow wide sheets to be passed through the blast cleaner.

The spent shot falls downward to the bottom of chambers 12 and 17 where it is collected and moved by lower auger 34 as will be described further below.

Figure 2:
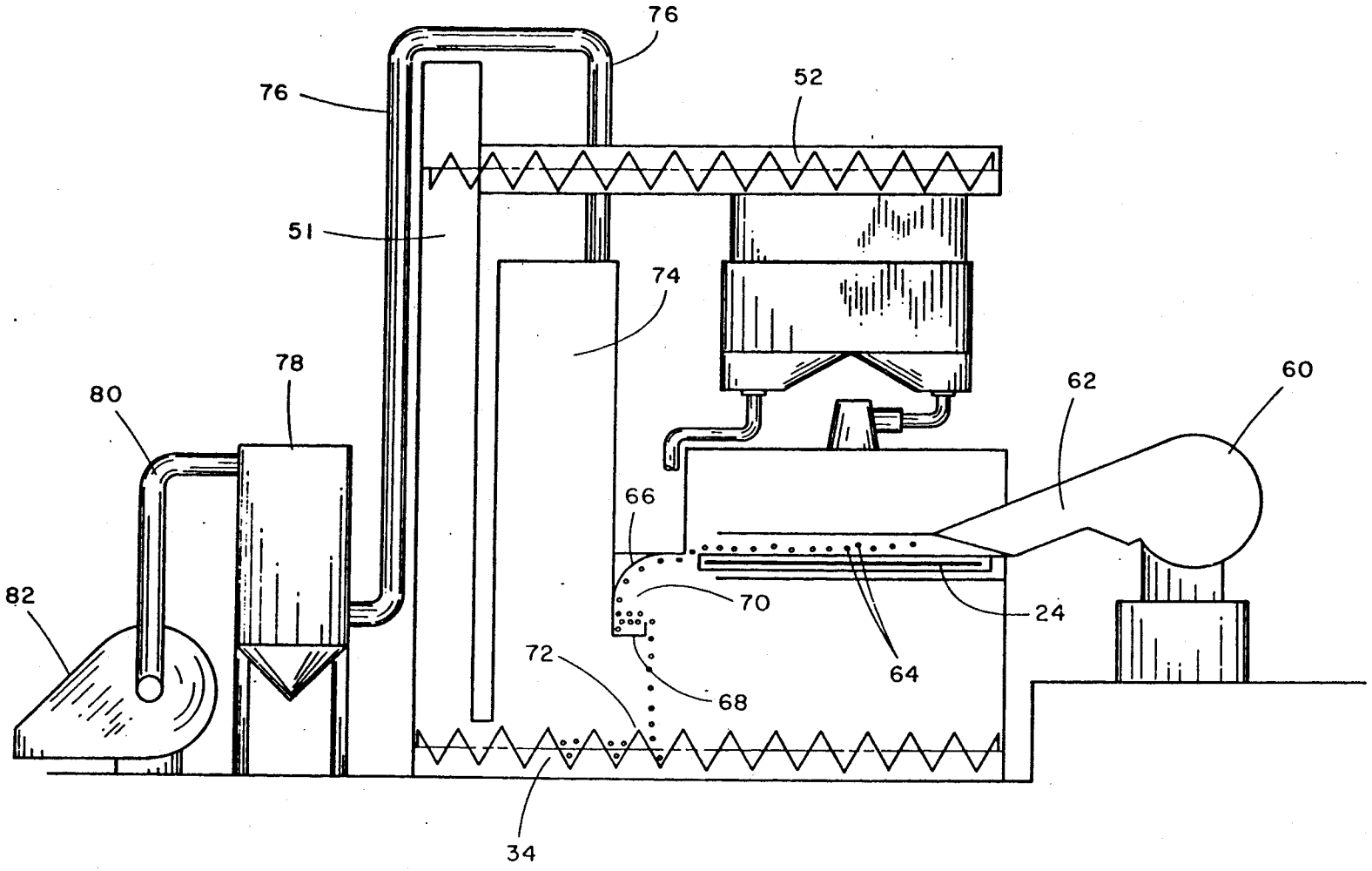
FIG. 2 illustrates a rear elevational cutaway view through A—A of FIG. 1 showing the shot removal chamber.

The workpiece passes over second conveyor roller 41 into shot removal chamber 17 where, as seen in FIG. 2, blower 60, not seen in FIG. 1, directs a strong current of air through funnel 62 at a velocity of 5,000–10,000 linear feet per minute with an air volume at 10,000–20,000 cubic feet per minute through aperture 44 which blows shot 64 off the top surface of workpiece 24. At the same time a high suction is provided in shot removal chamber 17 at the other side of the workpiece from another blower 82 which pulls at a level to move a greater volume of air than blower 60. The shot being blown and also being pulled by suction off the top surface of the workpiece strikes curved deflector plate 66 which directs the shot down into shot catch member 68 where the shot builds up and then spills downward to lower auger 34 where it is moved by rotation of the auger to elevator 51 which carries it upward to head chute 61 which directs the shot to upper auger 52 where it is eventually directed to blast chamber 12. The shot falls through separator 53 into abrasive storage bin 55 where it passes through feed pipes to the blast wheels. First feed pipe 50 returns shot to first upper blast wheel 14, and second feed pipe 49 returns shot to first lower blast wheel 16.

Expansion chamber 74 as seen in FIG. 2 has a dust collector 78 attached thereto through vent pipe 76 and blower 82 provides sufficient upward suction through pipe 80 and through dust collector 78 within expansion chamber 74 to lift away debris and other material, which has been removed from the upper surface of the workpiece, from the shot which debris is sucked into dust collector 78 for filtering.

After all shot has been removed from the top surface of the workpiece, the workpiece then passes out exit door 48 seen in FIG. 1 of the blast chamber for further processing. Any shot on the upper surface of the sheet is removed by the blower/suction system directed laterally across the workpiece surface which also then separates the shot from the debris in the same operation in which shot is recycled for use.

Although the present invention has been described with reference to particular embodiments, it will be apparent to those skilled in the art that variations and modifications can be substituted therefor without departing from the principles and spirit of the invention.

I claim:

1. An improved shot removal system disposed to receive a metal sheet workpiece from a blast chamber after cleaning by shot blast cleaning devices to remove shot deposited on the top of said workpiece, comprising:

a shot removal chamber;

means for moving said workpiece through said shot removal chamber;

shot collection means located at the bottom of said shot removal chamber;

a blower adapted to blow air into said shot removal chamber laterally across the top surface of said workpiece, said blower positioned perpendicular to the direction of movement of said workpiece within said shot removal chamber, said blower blowing air perpendicular to the direction of movement of said workpiece across the top surface of said workpiece; and suction means disposed on the other side of the top surface of said workpiece from said blower, said suction means pulling large volumes of air and shot in the same direction as said blower is blowing shot, said shot being blown and sucked off the top of said workpiece to fall to the bottom of said shot removal chamber.

2. The device of claim 1 further including means to separate shot from waste debris.

3. The device of claim 2 further including return means for recycling shot for re-utilization by said blast cleaning device.

4. The device of claim 3 wherein a greater volume of air is pulled by said suction means than is blown by said blower.

5. The device of claim 4 wherein said blower blows air at the rate of 5,000–10,000 linear feet per minute moving an air volume of 10,000 to 20,000 cubic feet per minute.

6. The device of claim 5 wherein said removal chamber is 2 inches to 10 inches in height.

* * * * *